US007705708B2

(12) United States Patent
Matsuoka et al.

(10) Patent No.: US 7,705,708 B2
(45) Date of Patent: Apr. 27, 2010

(54) VARISTOR AND METHOD OF PRODUCING THE SAME

(75) Inventors: Dai Matsuoka, Nikaho (JP); Yo Saito, Yurihonjo (JP)

(73) Assignee: TDK Corporation, Tokyo (JP)

( * ) Notice: Subject to any disclaimer, the term of this patent is extended or adjusted under 35 U.S.C. 154(b) by 723 days.

(21) Appl. No.: 11/389,240

(22) Filed: Mar. 27, 2006

(65) Prior Publication Data

US 2006/0220780 A1 Oct. 5, 2006

(30) Foreign Application Priority Data

Apr. 1, 2005 (JP) ..... P2005-106155
Apr. 1, 2005 (JP) ..... P2005-106159

(51) Int. Cl.
*H01C 7/10* (2006.01)

(52) U.S. Cl. ..... 338/21

(58) Field of Classification Search ..... 338/21
See application file for complete search history.

(56) References Cited

U.S. PATENT DOCUMENTS 5,153,554 A * 10/1992 Becker et al. ..... 338/21
5,455,555 A * 10/1995 Onabuta ..... 338/20
5,870,273 A 2/1999 Sogabe et al.

FOREIGN PATENT DOCUMENTS

| | | |
|---|---|---|
| CN | 1097271 C | 5/1998 |
| JP | A 06-120007 | 4/1994 |
| JP | A 9-320814 | 12/1997 |
| JP | A 2001-35706 | 2/2001 |
| JP | A 2002-64008 | 2/2002 |
| JP | A 2002-246207 | 8/2002 |
| JP | A-2004-026562 | 1/2004 |
| JP | A-2004-146675 | 5/2004 |
| JP | A-2005-079327 | 3/2005 |

* cited by examiner

*Primary Examiner*—Elvin G Enad
*Assistant Examiner*—Joselito Baisa
(74) *Attorney, Agent, or Firm*—Oliff & Berridge, PLC

(57) ABSTRACT

A varistor has a varistor element body, and an external electrode disposed on the varistor element body. The varistor element body contains ZnO as a principal component, and a rare-earth metal. The external electrode has an electrode layer. The electrode layer is formed on an external surface of the varistor element body by simultaneous firing with the varistor element body. The electrode layer contains Pd.

4 Claims, 11 Drawing Sheets

VARISTOR AND METHOD OF PRODUCING THE SAME

BACKGROUND OF THE INVENTION

1. Field of the Invention

The present invention relates to a varistor and, more particularly, to a varistor with a varistor element body consisting primarily of ZnO (zinc oxide), and a method of producing the varistor.

2. Related Background Art

One of the known varistors of this type is a varistor having a varistor element body, and external electrodes disposed on the varistor element body (e.g., reference is made to Japanese Patent Application Laid-Open No. 6-120007). In the varistor described in the Laid-Open No. 6-120007, the varistor element body contains ZnO as a principal component, and contains Bi as a material to develop nonlinear voltage-current characteristics (hereinafter referred to as "varistor characteristics").

The Laid-Open No. 6-120007 also discloses the following method of producing the varistor. First, the varistor element body is made by laminating ceramic green sheets in which conductor patterns to become internal electrodes are formed and ceramic green sheets without any conductor pattern, in a desired order and then firing the sheets. An electroconductive paste is applied onto the resultant varistor element body and thereafter baked to form the external electrodes.

SUMMARY OF THE INVENTION

An object of the present invention is to provide a varistor capable of achieving an improvement in bonding strength between a varistor element body consisting primarily of ZnO, and external electrodes, and a method of producing the same.

The Inventors conducted elaborate research on the varistor and production method thereof to achieve an improvement in bonding strength between the varistor element body primarily consisting of ZnO, and the external electrodes. As a result of the research, the Inventors found the new fact that the bonding strength between the varistor element body and the external electrodes varies according to materials contained in the varistor element body (a green body which becomes the varistor element body after fired) and the external electrodes (an electroconductive paste which becomes the external electrodes after fired).

The electroconductive paste is applied onto the external surface of the green body consisting primarily of ZnO, and thereafter they are fired to obtain the varistor element body and the external electrodes. At this time, the bonding strength between the varistor element body and the external electrodes obtained is improved if the green body contains a rare-earth metal (e.g., Pr (praseodymium) or the like) and if the electroconductive paste contains Pd (palladium).

The effect of the improvement in the bonding strength between the varistor element body and the external electrodes is considered to arise from the following phenomenon during the firing. During firing the green body and electroconductive paste, the rare-earth metal in the green body migrates to near the surface of the green body, i.e., to near the interface between the green body and the electroconductive paste. Then the rare-earth metal coming to near the interface between the green body and the electroconductive paste, and Pd in the electroconductive paste counter-diffuse. At this time, a compound of the rare-earth metal and Pd can be formed in the neighborhood of the interface between the varistor element body and each external electrode. The compound of the rare-earth metal and Pd offers an anchor effect to improve the bonding strength between the varistor element body and the external electrodes obtained by firing.

In light of the above fact, a varistor according to the present invention is a varistor comprising a varistor element body, and an external electrode disposed on the varistor element body, wherein the varistor element body comprises ZnO as a principal component, and a rare-earth metal, and wherein the external electrode comprises an electrode layer formed on an external surface of the varistor element body by simultaneous firing with the varistor element body, and comprising Pd.

In the varistor according to the present invention, the varistor element body comprises the rare-earth metal. The external electrode comprises the electrode layer formed on the external surface of the varistor element body by simultaneous firing with the varistor element body, and comprising Pd. By the simultaneous firing of the electrode layer with the varistor element body, a compound of the rare-earth metal and Pd is formed in the neighborhood of the interface between the varistor element body and the external electrode, and the compound exists there. This can achieve an improvement in the bonding strength between the varistor element body and the external electrode.

Another varistor according to the present invention is a varistor comprising a varistor element body, and an external electrode disposed on the varistor element body, wherein the varistor element body comprises ZnO as a principal component, and a rare-earth metal, wherein the external electrode comprises an electrode layer disposed on an external surface of the varistor element body and comprising Pd, and wherein a compound of the rare-earth metal in the varistor element body and Pd in the electrode layer exists near an interface between the varistor element body and the external electrode.

In the varistor according to the present invention, the compound of the rare-earth metal in the varistor element body and Pd in the electrode layer exists near the interface between the varistor element body and the external electrode, which can achieve an improvement in the bonding strength between the varistor element body and the external electrode.

Preferably, the electrode layer is formed on the external surface of the varistor element body by simultaneous firing with the varistor element body. In this case, the compound of the rare-earth metal in the varistor element body and Pd in the electrode layer can be securely made to exist near the interface between the varistor element body and the external electrode.

Preferably, the rare-earth metal in the varistor element body is Pr. In this case, the simultaneous firing of the electrode layer with the varistor element body results in forming an oxide of Pr and Pd, e.g., $Pr_2Pd_2O_5$ or $Pr_4PdO_7$ or the like near the interface between the varistor element body and the external electrode, and the oxide exists in the neighborhood of the interface. This can achieve an improvement in the bonding strength between the varistor element body and the external electrode.

Preferably, the external electrode further comprises another electrode layer disposed on the foregoing electrode layer. In this case, it is feasible to improve solder leaching resistance and solderability.

A production method of a varistor according to the present invention is a method of producing a varistor comprising a varistor element body, and an external electrode having an electrode layer disposed on an external surface of the varistor element body, the method comprising: a step of forming a green body comprising ZnO as a principal component, and a rare-earth metal; a step of applying an electroconductive paste comprising Pd, onto an external surface of the green body; and a step of firing the green body with the electroconductive paste thereon, to obtain the varistor element body and the electrode layer.

In the production method of the varistor according to the present invention, the green body comprises the rare-earth metal, the electroconductive paste comprises Pd, and the green body with the electroconductive paste thereon is fired to obtain the varistor element body and the electrode layer; therefore, the varistor element body and the electrode layer are simultaneously fired. The simultaneous firing of the electrode layer with the varistor element body results in forming a compound of the rare-earth metal and Pd near the interface between the varistor element body and the external electrode, and the compound exists in the neighborhood of the interface. This can achieve an improvement in the bonding strength between the varistor element body and the external electrode.

Preferably, the rare-earth element in the green body is Pr. In this case, the simultaneous firing of the electrode layer with the varistor element body results in forming an oxide of Pr and Pd, e.g., $Pr_2Pd_2O_5$ or $Pr_4PdO_7$ or the like near the interface between the varistor element body and the external electrode, and the oxide exists in the neighborhood of the interface. This can achieve an improvement in the bonding strength between the varistor element body and the external electrode.

The present invention successfully achieves the improvement in the bonding strength between the varistor element body comprising ZnO as a principal component, and the external electrode.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Preferred embodiments of the present invention will be described below in detail with reference to the accompanying drawings. In the description identical elements or elements with identical functionality will be denoted by the same reference symbols, without redundant description.

First Embodiment

Figure 1:
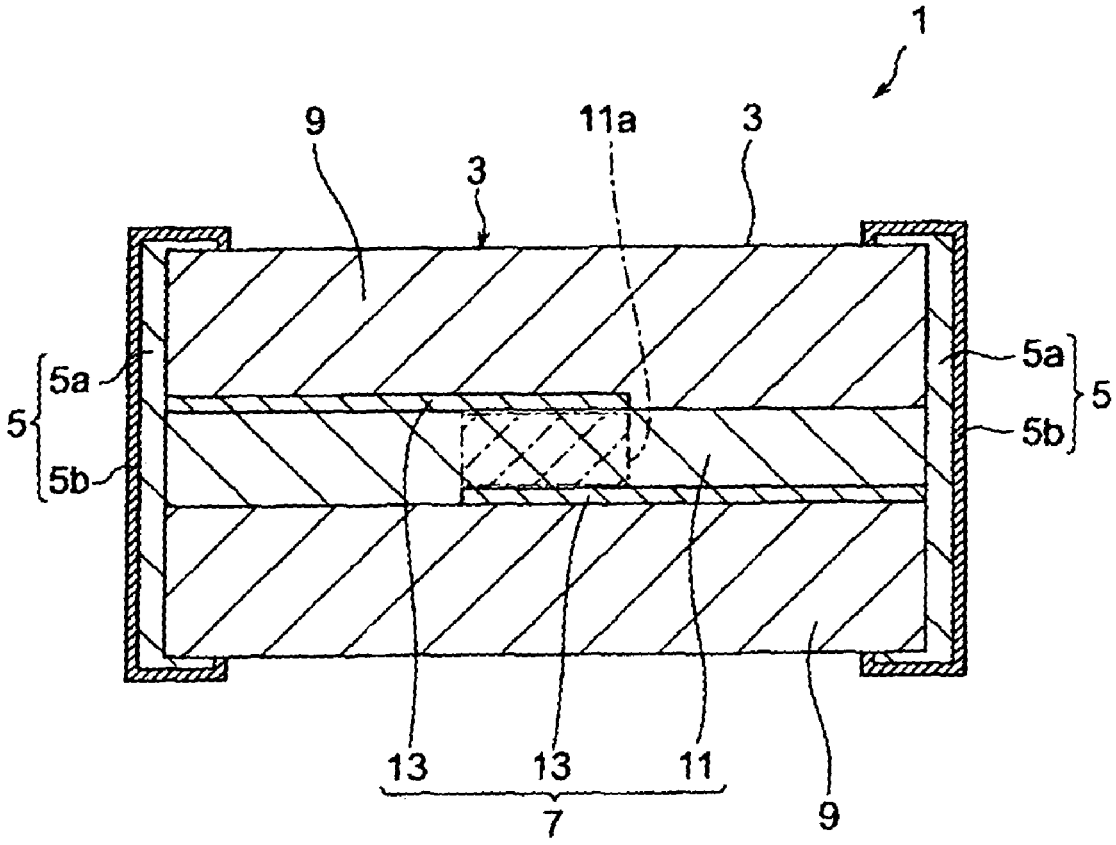
FIG. 1 is a view to illustrate a sectional configuration of a multilayer chip varistor according to the first embodiment.

First, a configuration of multilayer chip varistor 1 according to the first embodiment will be described with reference to FIG. 1. FIG. 1 is a view to illustrate a sectional configuration of the multilayer chip varistor according to the first embodiment The multilayer chip varistor 1, as shown in FIG. 1, comprises a varistor element body 3, and a pair of external electrodes 5. The external electrodes 5 are disposed on respective end faces opposed to each other in the varistor element body 3. The varistor element body 3 has a varistor portion 7, and a pair of outer portions 9 disposed so as to interpose the varistor portion 7 between them. The varistor element body 3 is constructed as a multilayer body in which the varistor portion 7 and the pair of outer portions 9 are stacked. The varistor element body 3 is of a rectangular parallelepiped shape, and is set, for example, to the length of 1.6 mm, the width of 0.8 mm, and the height of 0.8 mm. The multilayer chip varistor 1 of the present embodiment is a so called 1608 type multilayer chip varistor.

The varistor portion 7 includes a varistor layer 11 to exhibit the varistor characteristics, and a pair of internal electrodes 13 disposed so as to interpose the varistor layer 11 between them. In the varistor portion 7, the varistor layer 11 and internal electrodes 13 are alternately laminated. A region 11*a* overlapping in the varistor layer 11 with the pair of internal electrodes 13 functions as a region to exhibit the varistor characteristics.

The varistor layer 11 contains ZnO (zinc oxide) as a principal component, and also contains as accessory components single metals such as rare-earth metals, Co, IIIb elements (B, Al, Ga, In), Si, Cr, Mo, alkali metal elements (K, Rb, Cs), and alkaline earth metals (Mg, Ca, Sr, Ba), or oxides of them. In the present embodiment, the varistor layer 11 contains Pr, Co, Cr, Ca, Si, K, Al, and so on as accessory components. The region 11*a* overlapping in the varistor layer 11 with the pair of internal electrodes 13 contains ZnO as a principal component, and also contains Pr.

Here Pr is a material for making the region 11*a* exhibit the varistor characteristics. The reason why Pr is used is that it is excellent in develop nonlinear voltage-current characteristics and has little characteristic variation in mass production. There are no particular restrictions on the content of ZnO in the varistor layer 11, but the content of ZnO is normally 99.8-69.0% by mass, based on 100% by mass of all the materials constituting the varistor layer 11. The thickness of the varistor layer 11 is, for example, approximately 5-60 μm.

The pair of internal electrodes 13 are arranged approximately in parallel so that one ends of the respective electrodes are alternately exposed in end faces opposed to each other in the varistor element body 3. Each internal electrode 13 is electrically connected at the one end described above, with the external electrode 5. The internal electrodes 13 contain an electroconductive material. There are no particular restrictions on the electroconductive material in the internal electrodes 13, but the electroconductive material is preferably Pd or Ag—Pd alloy. The thickness of the internal electrodes 13 is, for example, approximately 0.5-5 μm.

Just like the varistor layer 11, the outer portions 9 contain ZnO as a principal component and also contain as accessory components single metals, such as rare-earth metals, Co, IIIb elements (13, Al, Ga, In), Si, Cr, Mo, alkali metal elements (K, Rb, Cs), and alkaline earth metals (Mg, Ca, Sr, Ba), or oxides of them. In the present embodiment the outer portions 9 contain Pr, Co, Cr, Ca, Si, K, Al, and so on as accessory components. The outer portions 9 contain ZnO as a principal component and also contain Pr. The thickness of the outer portions 9 is, for example, approximately 0.10-0.38 mm.

The external electrodes 5 are arranged so as to cover the two end faces of the varistor element body 3. Each of the pair of external electrodes 5 has a first electrode layer 5*a* and a second electrode layer 5*b*. The first electrode layer 5*a* is disposed on the outer surface of the varistor element body 3 and contains Pd. The first electrode layer 5*a* is formed by firing an electroconductive paste as described later. The electroconductive paste is a paste in which an organic binder and an organic solvent are mixed in metal powder consisting primarily of Ag—Pd alloy particles. The metal powder may be one consisting primarily of Pd particles.

The second electrode layer 5*b* is disposed on the first electrode layer 5*a*. The second electrode layer 5*b* is formed by plating. In the present embodiment, the second electrode layer 5*b* includes a Ni plated layer formed by Ni plating on the first electrode layer 5*a*, and a Sn plated layer formed by Sn plating on the Ni plated layer. The second electrode layer 5*b* is formed for the primary purpose of improving the solder leaching resistance and solderability in a process of mounting the multilayer chip varistor 1 on an external substrate or the like by solder reflow.

The second electrode layer 5*b* is not always limited to the above-described combination of materials as long as the purpose of improving the solder leaching resistance and solderability is achieved. Another material capable of forming a plated layer is, for example, Sn—Pb alloy or the like, and it can be suitably used in combination with Ni and Sn described above. The plated layers are not always limited to the two-layer structure, but may have a structure of one layer or, three or more layers.

Figure 2:
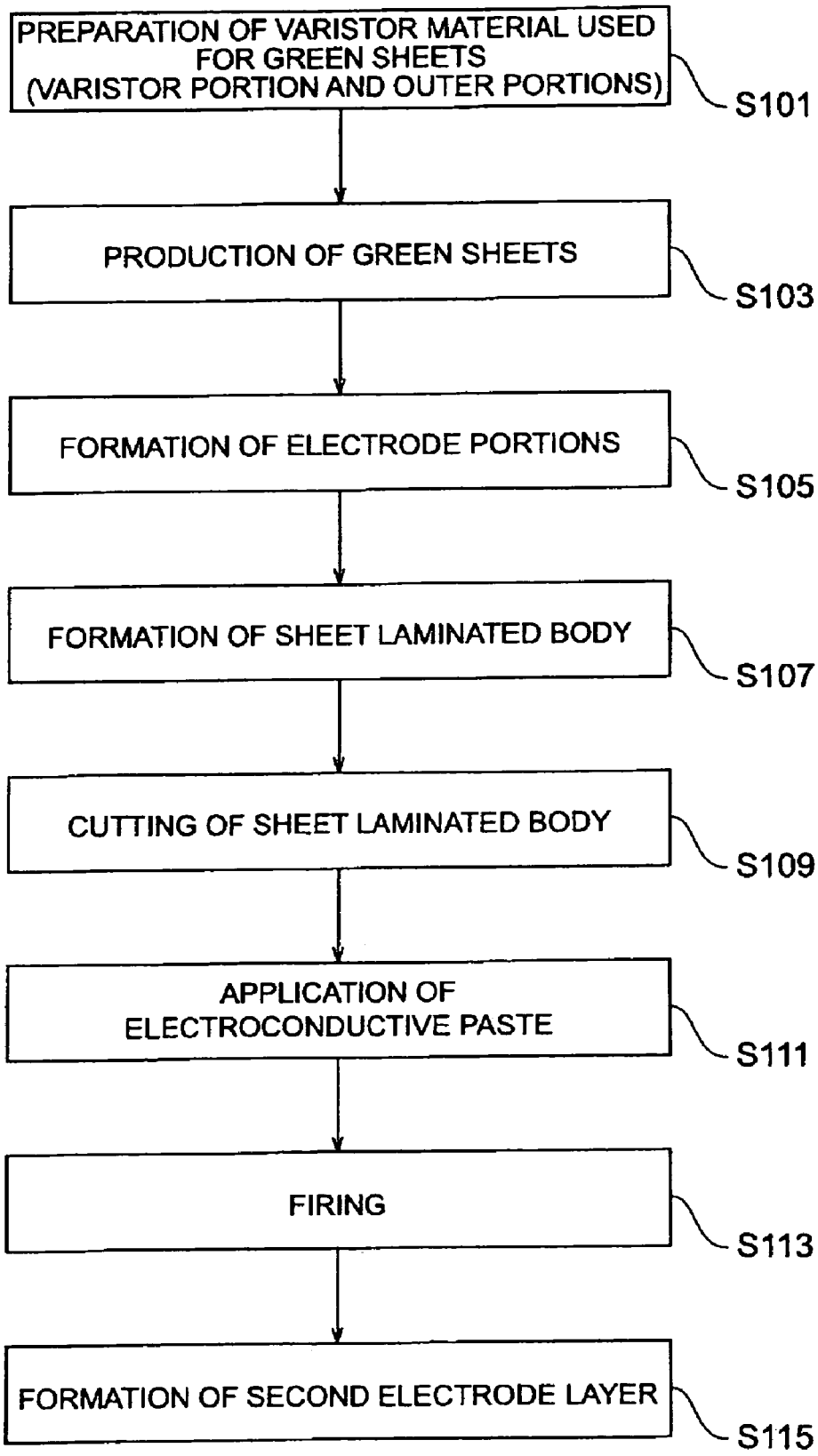
FIG. 2 is a flowchart for explaining a production process of the multilayer chip varistor according to the first embodiment.
Figure 3:
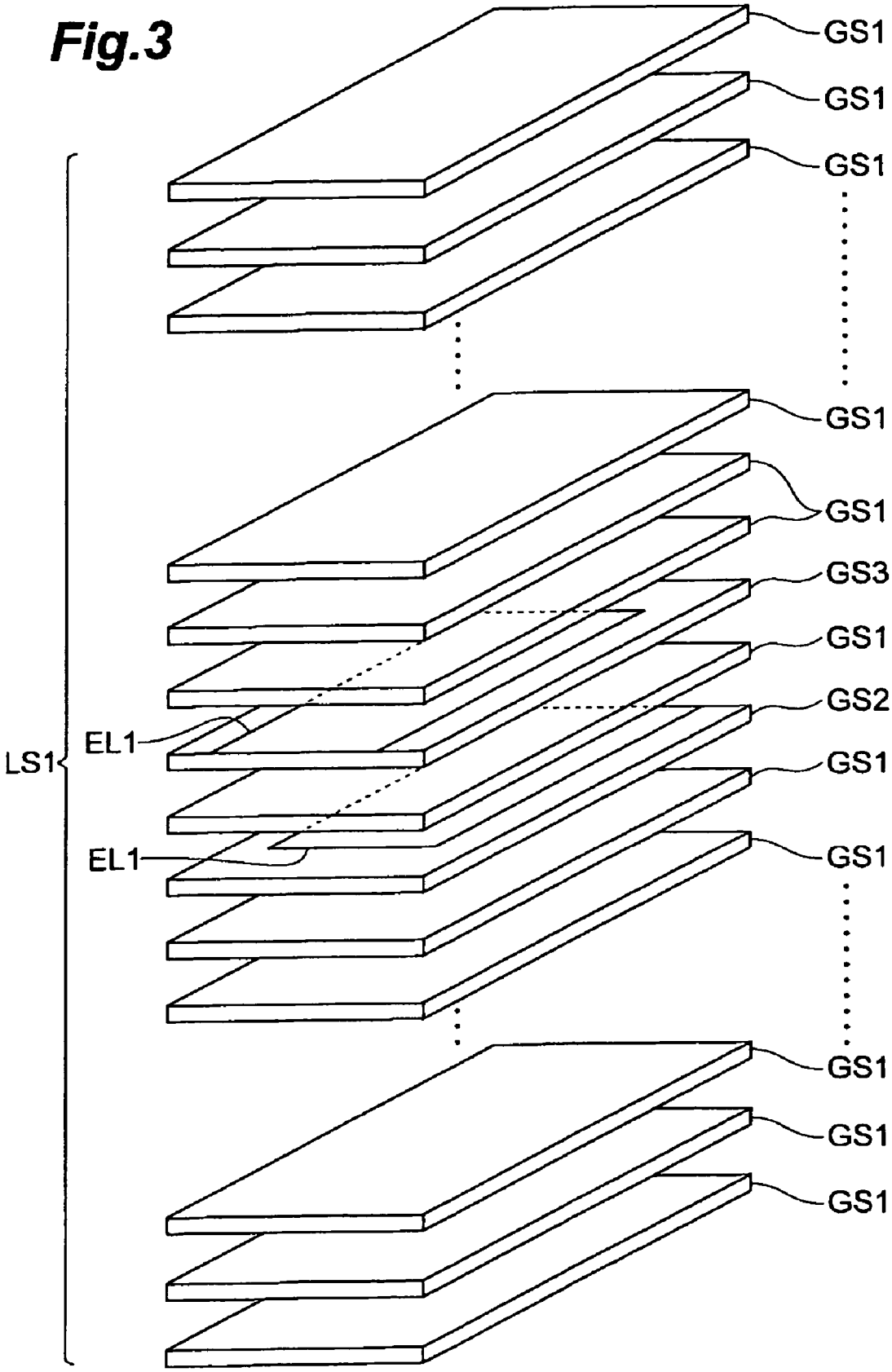
FIG. 3 is an illustration for explaining the production process of the multilayer chip varistor according to the first embodiment.

Subsequently, a production process of the multilayer chip varistor 1 having the above-described configuration will be described with reference to FIGS. 1 to 3. FIG. 2 is a flowchart for explaining the production process of the multilayer chip varistor according to the first embodiment FIG. 3 is an illustration for explaining the production process of the multilayer chip varistor according to the first embodiment.

First, ZnO as the principal component of the varistor layer 11 and outer portions 9, and the additives of small amount, such as the metals or oxides of Pr, Co, Cr, Ca, Si, K, and Al, are weighed at a predetermined ratio, and the components are mixed to prepare a varistor material (step S101). Thereafter, an organic binder, an organic solvent, an organic plasticizer, etc. are added into the varistor material, and they are mixed and pulverized for about 20 hours by a ball mill or the like to obtain a slurry.

The above slimy is applied onto film, for example, of polyethylene terephthalate by a known method such as the doctor blade method, and thereafter dried to form membranes in the thickness of about 30 μm. The membranes obtained in this manner are peeled off from the polyethylene terephthalate film to obtain green sheets (step S103).

Next, a plurality of electrode portions corresponding to the internal electrodes 13 are formed (in a number corresponding to the number of divided chips described later) on green sheets (step S105). The electrode portions corresponding to the internal electrodes 13 are formed by printing an electroconductive paste by a printing method such as screen printing, and drying it. The electroconductive paste herein is a paste in which metal powder consisting primarily of Pd particles is mixed with an organic binder and an organic solvent Next, green sheets with electrode portions, and green sheets without electrode portions are laminated in a predetermined order to form a sheet laminated body (step S107). The sheet laminated body obtained in this manner is cut in chip units to obtain a plurality of divided green bodies LS1 (cf. FIG. 3) (step S109). In each green body LS1 obtained, green sheets GS1-GS3 are laminated in an order of a plurality of green sheets GS1 without electrode portion EL1, a green sheet GS2 with an electrode portion EL1, a plurality of green sheets GS1 without electrode portion EL1, a green sheet GS3 with an electrode portion EL1, and a plurality of green sheets GS1 without electrode portion EL1. It is noted that the green sheet GS1 without electrode portion EL1 does not always have to be laid between the green sheet GS2 and the green sheet GS3.

Next, an electroconductive paste for external electrodes 5 (first electrode layers 5*a*) is applied onto the outer surface of the green body LS1 (step S111). The electroconductive paste is applied onto the two ends of the green body LS1 so as to contact each of the pair of electrode portions EL1, and dried. The electroconductive paste for external electrodes 5 can be a paste in which an organic binder and an organic solvent are mixed in metal powder consisting primarily of Ag—Pd alloy particles or Pd particles, as described above. This electroconductive paste contains no glass frit Next, the green body LS1 with the electroconductive paste is subjected to a heat treatment at 180-400° C. and for about 0.5-24 hours to effect debinder, and is further fired at 1000-1400° C. for about 0.5-8 hours (step S113) to obtain the varistor element body 3 and the first electrode layers 5*a* of the external electrodes 5. This firing turns the green sheets GS1, GS3 between the electrode portions EL1 in the green body LS1 into the varistor layer 11, and turns the electrode portions EL1 into the internal electrodes 13.

Next, a Ni plated layer and a Sn plated layer are successively deposited on the first electrode layers 5*a* of the external electrodes 5 to form the second electrode layers 5*b* (step S1115). This completes the multilayer chip varistor 1. The Ni plating can be conducted by a barrel plating method using a Ni plating bath (e.g., a Watts nickel bath). The Sn plating can be performed by a barrel plating method using a Sn plating bath (e.g., a neutral Sn plating bath). After the firing, an alkali metal (e.g., Li, Na, or the like) may be diffused from the surface of the varistor element body 3.

In the present first embodiment, as described above, the green body LS1 contains Pr, the electroconductive paste for external electrodes 5 contains Pd, and the green body LS1 with the electroconductive paste thereon is fired to obtain the varistor element body 3 and the first electrode layers 5*a*; therefore, the varistor element body 3 and first electrode layers 5*a* are simultaneously fired. This can achieve an improvement in the bonding strength between the varistor element body 3 and the external electrodes 5 (first electrode layers 5*a*).

The effect of the improvement in the bonding strength between the varistor element body 3 and the external electrodes 5 is considered to arise from the following phenomenon during the firing. During the firing of the green body LS1 and the electroconductive paste, Pr in the green body LS1 migrates to near the surface of the green body LS1, i.e., to near the interface between the green body LS1 and the electroconductive paste. Then Pr coming to near the interface between the green body LS1 and the electroconductive paste and Pd in the electroconductive paste counter-diffuse. As Pr and Pd counter-diffuse, an oxide of Pr and Pd (e.g., $Pr_2Pd_2O_5$ or $Pr_4PdO_7$ or the like) can be formed in the neighborhood of the interface (including the interface) between the varistor element body 3 and the external electrodes 5. The oxide of Pr and Pd offers the anchor effect to achieve the improvement in the bonding strength between the varistor element body 3 and the external electrodes 5 obtained by the firing.

Incidentally, if the electroconductive paste for formation of the first electrode layers 5*a* should contain glass frit, the glass component could separate out to the surfaces of the first electrode layers 5*a* during the firing to degrade plateability and solder wettability. However, since in the present first embodiment the electroconductive paste for formation of the first electrode layers 5*a* contains no glass frit, there occurs no degradation of plateability and solder wettability.

Second Embodiment

Figure 4:
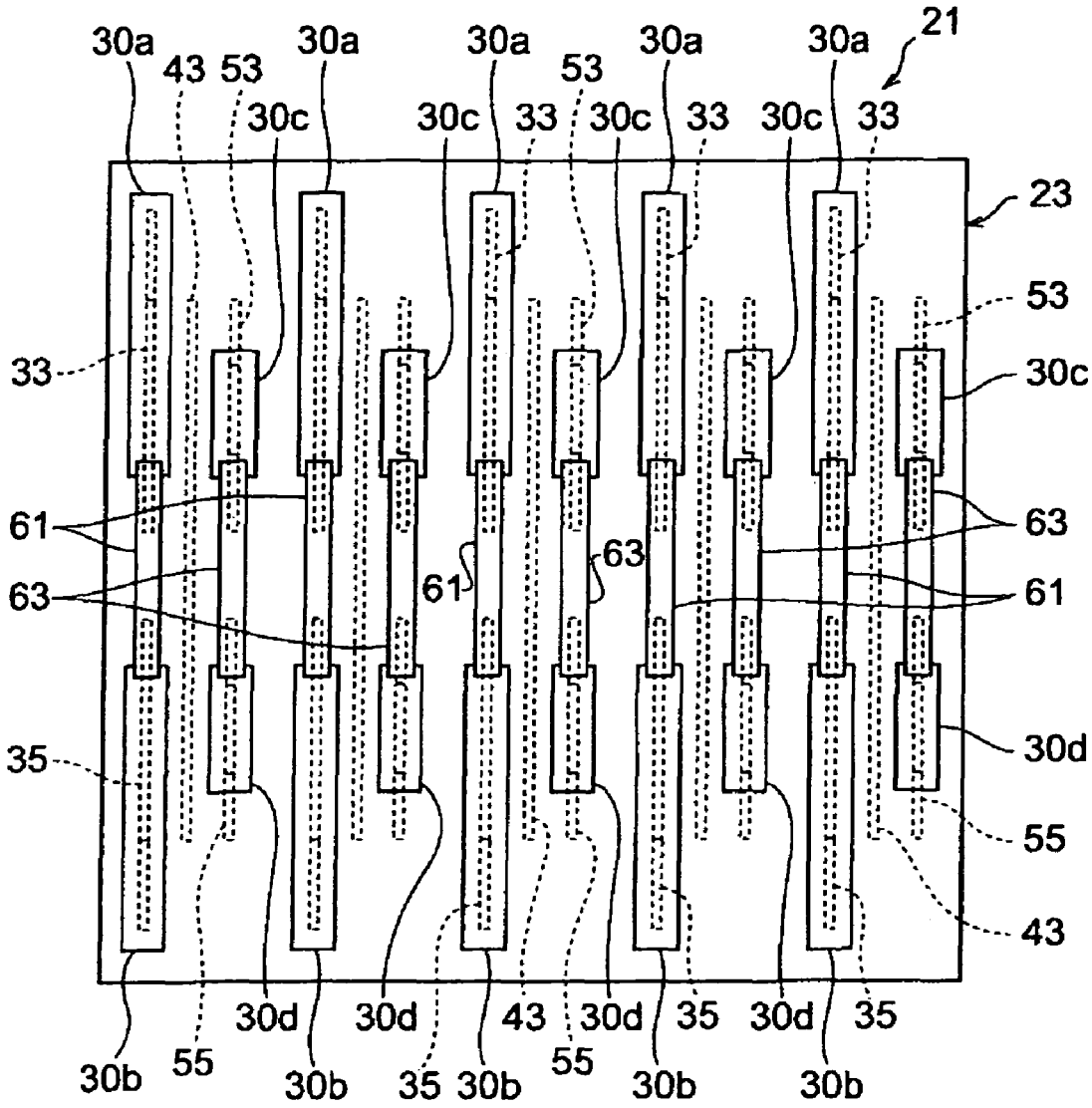
FIG. 4 is a schematic top view showing a multilayer chip varistor according to the second embodiment
Figure 5:
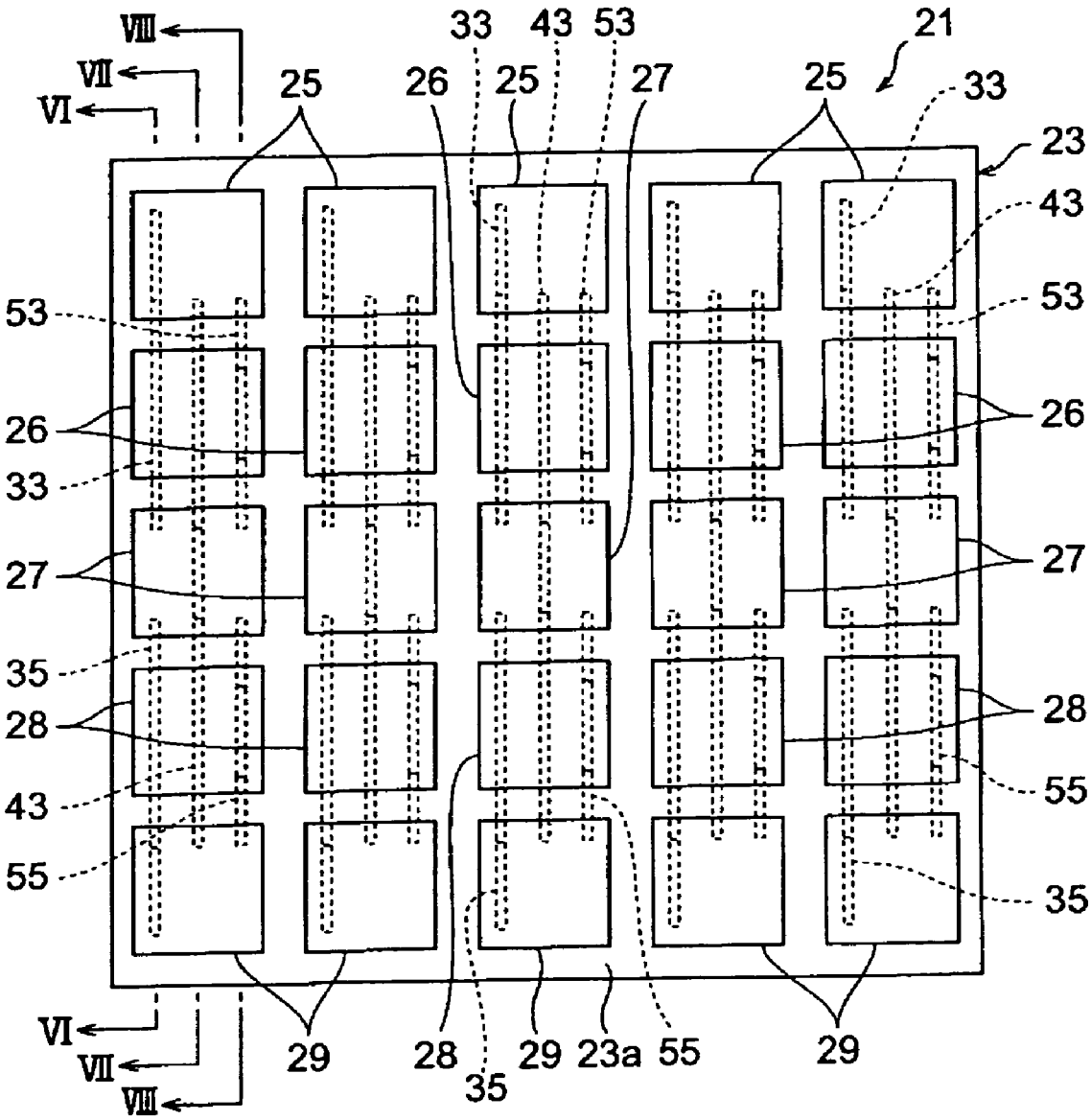
FIG. 5 is a schematic bottom view showing the multilayer chip varistor according to the second embodiment
Figure 6:
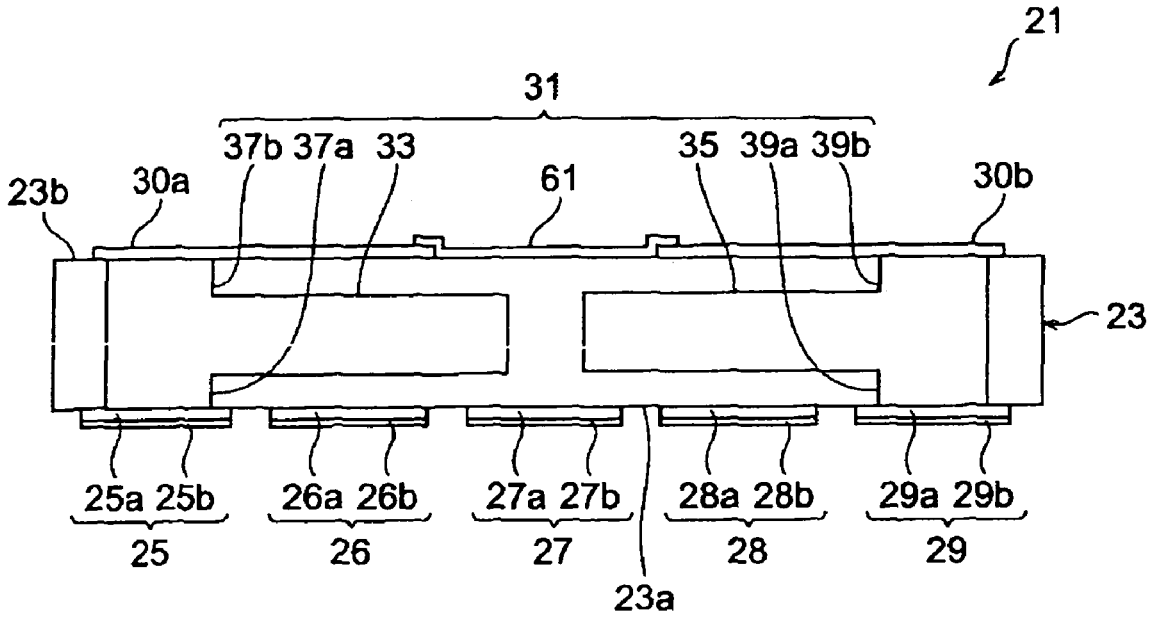
FIG. 6 is a view for explaining a sectional configuration along line VI-VI in FIG. 5.
Figure 7:
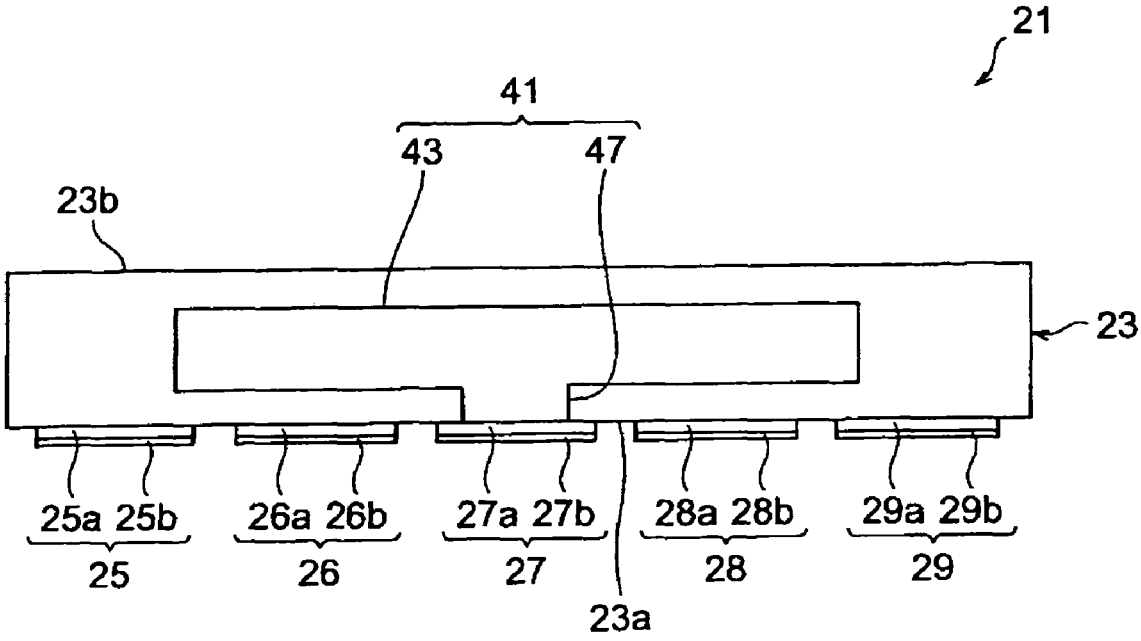
FIG. 7 is a view for explaining a sectional configuration along line VII-VII in FIG. 5.
Figure 8:
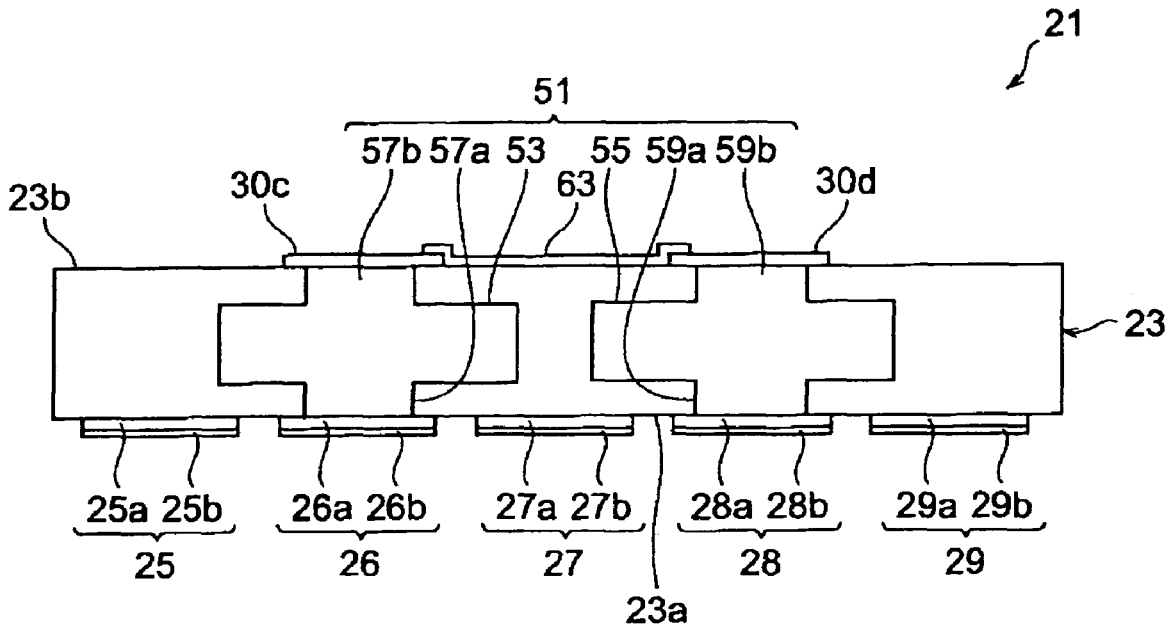
FIG. 8 is a view for explaining a sectional configuration along line VIII-VIII in FIG. 5.

Subsequently, a configuration of multilayer chip varistor 21 according to the second embodiment will be described with reference to FIGS. 4 to 8. FIG. 4 is a schematic top view showing the multilayer chip varistor of the second embodiment. FIG. 5 is a schematic bottom view showing the multilayer chip varistor of the second embodiment. FIG. 6 is a view for explaining a sectional configuration along line VI-VI in FIG. 5. FIG. 7 is a view for explaining a sectional configuration along line VII-VII in FIG. 5. FIG. 8 is a view for explaining a sectional configuration along line VIII-VIII in FIG. 5.

The multilayer chip varistor 21, as shown in FIGS. 4 to 8, has a varistor element body 23 of an approximately rectangular plate shape, a plurality of (twenty five in the present embodiment) external electrodes 25-29, and a plurality of (twenty in the present embodiment) external electrodes 30*a*-30*d*. The plurality of external electrodes 25-29 are disposed each on a first principal surface (bottom surface) 23*a* of the varistor element body 23. The plurality of external electrodes 30*a*-30*d* are disposed each on a second principal surface (top surface) 23*b* of the varistor element body 23. The first principal surface 23*a* and the second principal surface 23*b* face each other. The varistor element body 23 is set, for example, to the vertical length of about 3 mm, the horizontal length of about 3 mm, and the thickness of about 0.5 mm. The external electrodes 25, 26, 28, 29 function as input/output terminal electrodes of the multilayer chip varistor 21. The external electrodes 27 function as ground terminal electrodes of the multilayer chip varistor 21. The external electrodes 30*a*-30*d* function as pad electrodes electrically connected to after-described resistors 61-63.

The varistor element body 23 is constructed as a multilayer body in which a plurality of varistor layers and a plurality of first to third internal electrode layers 31, 41, 51 are laminated. When the first to third internal electrode layers 31, 41, 51 one each are defined as one internal electrode group, a plurality of (five in the present embodiment) such internal electrode groups are arranged along a laminate direction of the varistor layers (hereinafter referred to simply as "laminate direction") in the varistor element body 23. In each internal electrode group, the first to third internal electrode layers 31, 41, 51 are arranged in the order of the first internal electrode layer 31, the second internal electrode layer 41, and the third internal electrode layer 51 so that at least one varistor layer is interposed between them. The internal electrode groups are also arranged so that at least one varistor layer is interposed between them. In practical multilayer chip varistor 21, the plurality of varistor layers are integrally formed so that no boundary can be visually recognized between them.

Just like the varistor layer 11 in the first embodiment, each varistor layer contains ZnO (zinc oxide) as a principal component and also contains as accessory components single metals, such as rare-earth metals, Co, IIIb elements (B, Al, Ga, In), Si, Cr, Mo, alkali metal elements (K, Rb, Cs), and alkaline earth metals (Mg, Ca, Sr, Ba), or oxides of them. In the second embodiment the varistor layers contain Pr, Co, Cr, Ca, Si, K, Al, and so on as accessory components.

Each first internal electrode layer 31, as shown in FIG. 6, includes a first internal electrode 33 and a second internal electrode 35. Each of the first and second internal electrodes 33, 35 is of an approximately rectangular shape. The first and second internal electrodes 33, 35 are located at respective positions with a predetermined space from side faces parallel to the laminate direction in the varistor element body 23. The first internal electrode 33 and the second internal electrode 35 have such a predetermined space as to be electrically isolated from each other.

Each first internal electrode 33 is electrically connected via a lead conductor 37*a* to an external electrode 25 and is electrically connected via a lead conductor 37*b* to an external electrode 30*a*. The lead conductors 37*a*, 37*b* are integrally formed with the first internal electrode 33. The lead conductor 37*a* extends from the first internal electrode 33 so as to face the first principal surface 23*a* of the varistor element body 23. The lead conductor 37*b* extends from the first internal electrode 33 so as to face the second principal surface 23*b* of the varistor element body 23. Each second internal electrode 35 is electrically connected via a lead conductor 39*a* to an external electrode 29 and electrically connected via a lead conductor 39*b* to an external electrode 30*b*. The lead conductors 39*a*, 39*b* are integrally formed with the second internal electrode 35. The lead conductor 39*a* extends from the second internal electrode 35 so as to face the first principal surface 23*a* of the varistor element body 23. The lead conductor 39*b* extends from the second internal electrode 35 so as to face the second principal surface 23*b* of the varistor element body 23.

Each second internal electrode layer 41, as also shown in FIG. 7, includes a third internal electrode 43. Each third internal electrode 43 is of an approximately rectangular shape. The third internal electrode 43 is located at a position with a predetermined space from the side faces parallel to the laminate direction in the varistor element body 23. The third internal electrode 43 is arranged so as to overlap with the first and second internal electrodes 33, 35, when viewed from the laminate direction. Each third internal electrode 43 is electrically connected via a lead conductor 47 to an external electrode 27. The lead conductor 47 is integrally formed with the third internal electrode 43. Each lead conductor 47 extends from the third internal electrode 43 so as to face the first principal surface 23*a* of the varistor element body 23.

Each third internal electrode layer 51, as also shown in FIG. 8, includes a fourth internal electrode 53 and a fifth internal electrode 55. Each of the fourth and fifth internal electrodes 53, 55 is of an approximately rectangular shape. The fourth and fifth internal electrodes 53, 55 are located at respective positions with a predetermined space from the side faces parallel to the laminate direction in the varistor element body 23. The fourth and fifth internal electrodes 53, 55 overlap with the third internal electrode 43, when viewed from the laminate direction. The fourth internal electrode 53 and the fifth internal electrode 55 have such a predetermined space as to be electrically isolated from each other.

Each fourth internal electrode 53 is electrically connected via a lead conductor 57*a* to an external electrode 26 and electrically connected via a lead conductor 57*b* to an external electrode 30*c*. The lead conductors 57*a*, 57*b* are integrally formed with the fourth internal electrode 53. The lead conductor 57*a* extends from the fourth internal electrode 53 so as to face the first principal surface 23*a* of the varistor element body 23. The lead conductor 57*b* extends from the fourth internal electrode 53 so as to face the second principal surface 23*b* of the varistor element body 23. Each fifth internal electrode 55 is electrically connected via a lead conductor 59*a* to an external electrode 28 and electrically connected via a lead conductor 59*b* to an external electrode 30*d*. The lead conductors 59*a*, 59*b* are integrally formed with the fifth internal electrode 55. The lead conductor 59*a* extends from the fifth internal electrode 55 so as to face the first principal surface 23*a* of the varistor element body 23. The lead conductor 59*b* extends from the fifth internal electrode 55 so as to face the second principal surface 23*b* of the varistor element body 23.

The first to fifth internal electrodes 33, 35, 43, 53, 55 contain Pd or Ag—Pd alloy as the internal electrode 13 in the first embodiment does. The lead conductors 37*a*, 37*b*, 39*a*, 39*b*, 47, 57*a*, 57*b*, 59*a*, 59*b* also contain Pd or Ag—Pd alloy.

The external electrodes 25-29 are two-dimensionally arrayed in a matrix of M rows and N columns (where each of parameters M and N is an integer of not less than 2) on the first principal surface 23*a*. In the present embodiment the external electrodes 25-29 are two-dimensionally arrayed in a matrix of 0.5 rows and 5 columns. The external electrodes 25-29 are of a rectangular shape (square shape in the present embodiment). The external electrodes 25-29 are set, for example, to the length of about 300 μm on each side and the thickness of about 2 μm.

Each of the external electrodes 25-29 has a first electrode layer 25*a*-29*a* and a second electrode layer 25*b*-29*b*. The first electrode layers 25*a*-29*a* are placed on the outer surface of the varistor element body 23 and contain Pd. The first electrode layers 25*a*-29*a* are formed by firing an electroconductive paste, as the first electrode layers 5*a* in the first embodiment are. The electroconductive paste is a paste in which an organic binder and an organic solvent are mixed in metal powder consisting primarily of Pd particles. The metal powder may be one consisting primarily of Ag—Pd alloy particles.

The second electrode layers 25*b*-29*b* are disposed on the respective first electrode layers 25*a*-29*a*. The second electrode layers 25*b*-29*b* are formed by printing or by plating. The second electrode layers 25*b*-29*b* are made of Au or Pt. When the printing method is applied, a paste prepared is an electroconductive paste in which an organic binder and an organic solvent are mixed in metal powder consisting primarily of Au particles or Pt particles, the electroconductive paste is printed on the first electrode layers 25*a*-29*a*, and the electroconductive paste is baked or fired to form the second electrode layers 25*b*-29*b*. When the plating method is applied, Au or Pt is evaporated by a vacuum plating method (vacuum vapor deposition, sputtering, ion plating, or the like) to form the second electrode layers 25*b*-29*b*. The second electrode layers 25*b*-29*b* of Pt are suitable mainly for mounting the multilayer chip varistor 21 on an external substrate or the like by solder reflow, and can achieve an improvement in the solder leaching resistance and solderability. The second electrode layers 25*b*-29*b* of Au are suitable mainly for mounting the multilayer chip varistor 21 on an external substrate or the like by wire bonding.

The external electrodes 30*a* and external electrodes 30*b* are placed on the second principal surface 23*b*. The external electrodes 30*a* and external electrodes 30*b* have a predetermined space in the direction perpendicular to the laminate direction of the varistor layers and parallel to the second principal surface 23*b*. The external electrodes 30*c* and external electrodes 30*d* are placed on the second principal surface 23*b*. The external electrodes 30*c* and external electrodes 30*d* have a predetermined space in the direction perpendicular to the laminate direction of the varistor layers and parallel to the second principal surface 23*b*. The predetermined space between the external electrodes 30*a* and the external electrodes 30*b* is equal to the predetermined space between the external electrodes 30*c* and the external electrodes 30*d*. The external electrodes 30*a*-30*d* are of a rectangular shape (oblong in the present embodiment). The external electrodes 30*a*, 30*b* are set, for example, to the length of the longer sides of about 1000 μm, the length of the shorter sides of about 150 μm, and the thickness of about 2 μm. The external electrodes 30*c*, 30*d* are set, for example, to the length of the longer sides of about 500 μm, the length of the shorter sides of about 150 μm, and the thickness of about 2 μm.

The external electrodes 30*a*-30*d* are formed by firing an electroconductive paste, as the first electrode layers 25*a*-29*a* are. This electroconductive paste is a paste in which an organic binder and an organic solvent are mixed in metal powder consisting primarily of Pd particles. The metal powder may be one consisting primarily of Ag—Pd alloy particles.

A resistor 61 is arranged so as to lie between each pair of external electrodes 30*a* and 30*b* and a resistor 63 is arranged so as to lie between each pair of external electrode 30*c* and external electrode 30*d*, on the second principal surface 23*b*. The resistors 61, 63 are formed by applying a Ru-based, Sn-based, or La-based resistive paste. The Ru-based resistive paste can be a paste in which glass such as $Al_2O_3$—$B_2O_3$—$SiO_2$ is mixed in $RuO_2$. The Sn-based resistive paste can be a paste in which glass such as $Al_2O_3$-$B_2O_3$—$SiO_2$ is mixed in $SnO_2$. The La-based resistive paste can be a paste in which glass such as $Al_2O_3$—$B_2O_3$—$SiO_2$ is mixed in $LaB_6$.

One end of each resistor 61 is electrically connected via an external electrode 30*a* and a lead conductor 37*b* to the first internal electrode 33. The other end of each resistor 61 is electrically connected via an external electrode 30*b* and a lead conductor 39*b* to the second internal electrode 35. One end of each resistor 63 is electrically connected via an external electrode 30*c* and a lead conductor 57*b* to the fourth internal electrode 53. The other end of each resistor 63 is electrically connected via an external electrode 30*d* and a lead conductor 59*b* to the fifth internal electrode 55.

Each third internal electrode 43, as described above, is arranged to overlap with the first and second internal electrodes 33, 35, when viewed from the laminate direction. Therefore, a region of the varistor layer overlapping with the first internal electrode 33 and with the third internal electrode 43 functions as a region to exhibit the varistor characteristics, and a region of the varistor layer overlapping with the second internal electrode 35 and with the third internal electrode 43 functions as a region to exhibit the varistor characteristics.

Each third internal electrode 43, as described above, is arranged to overlap with the fourth and fifth internal electrodes 53, 55, when viewed from the laminate direction. Therefore, a region of the varistor layer overlapping with the fourth internal electrode 53 and with the third internal electrode 43 functions as a region to exhibit the varistor characteristics, and a region of the varistor layer overlapping with the fifth internal electrode 55 and with the third internal electrode 43 functions as a region to exhibit the varistor characteristics.

Figure 9:
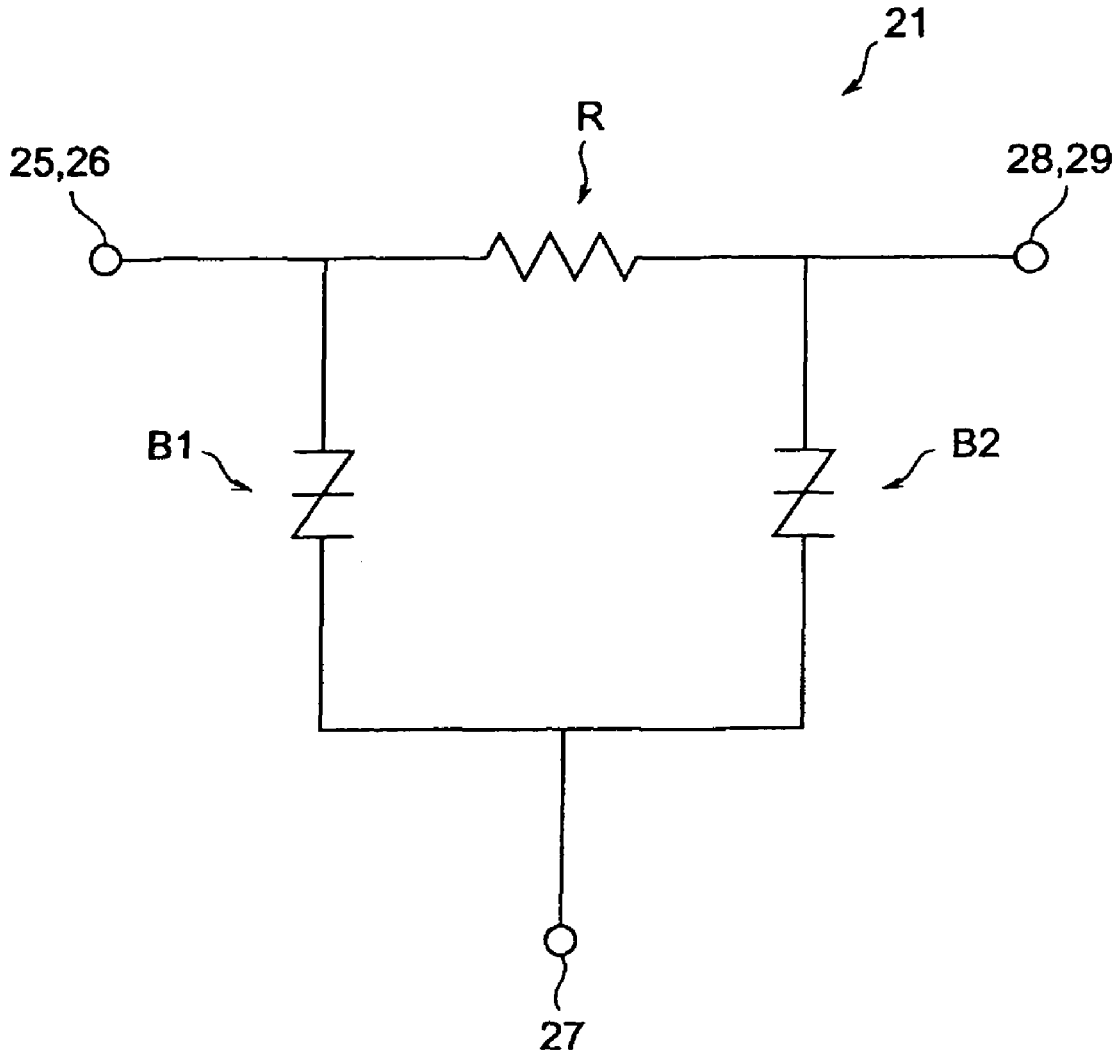
FIG. 9 is an illustration for explaining an equivalent circuit of the multilayer chip varistor according to the second embodiment.

In the multilayer chip varistor 21 of the above-described configuration, as shown in FIG. 9, resistor R, varistor B1, and varistor B2 are connected in π-shape. The resistor R is composed of resistor 61 or resistor 63. The varistor B1 is composed of the first internal electrode 33, the third internal electrode 43, and the region of the varistor layer overlapping with the first and third internal electrodes 33, 43, or of the fourth internal electrode 53, the third internal electrode 43, and the region of the varistor layer overlapping with the fourth and third internal electrodes 53, 43. The varistor B2 is composed of the second internal electrode 35, the third internal electrode 43, and the region of the varistor layer overlapping with the second and third internal electrodes 35, 43, or of the fifth internal electrode 55, the third internal electrode 43, and the region of the varistor layer overlapping with the fifth and third internal electrodes 55, 43.

Figure 10:
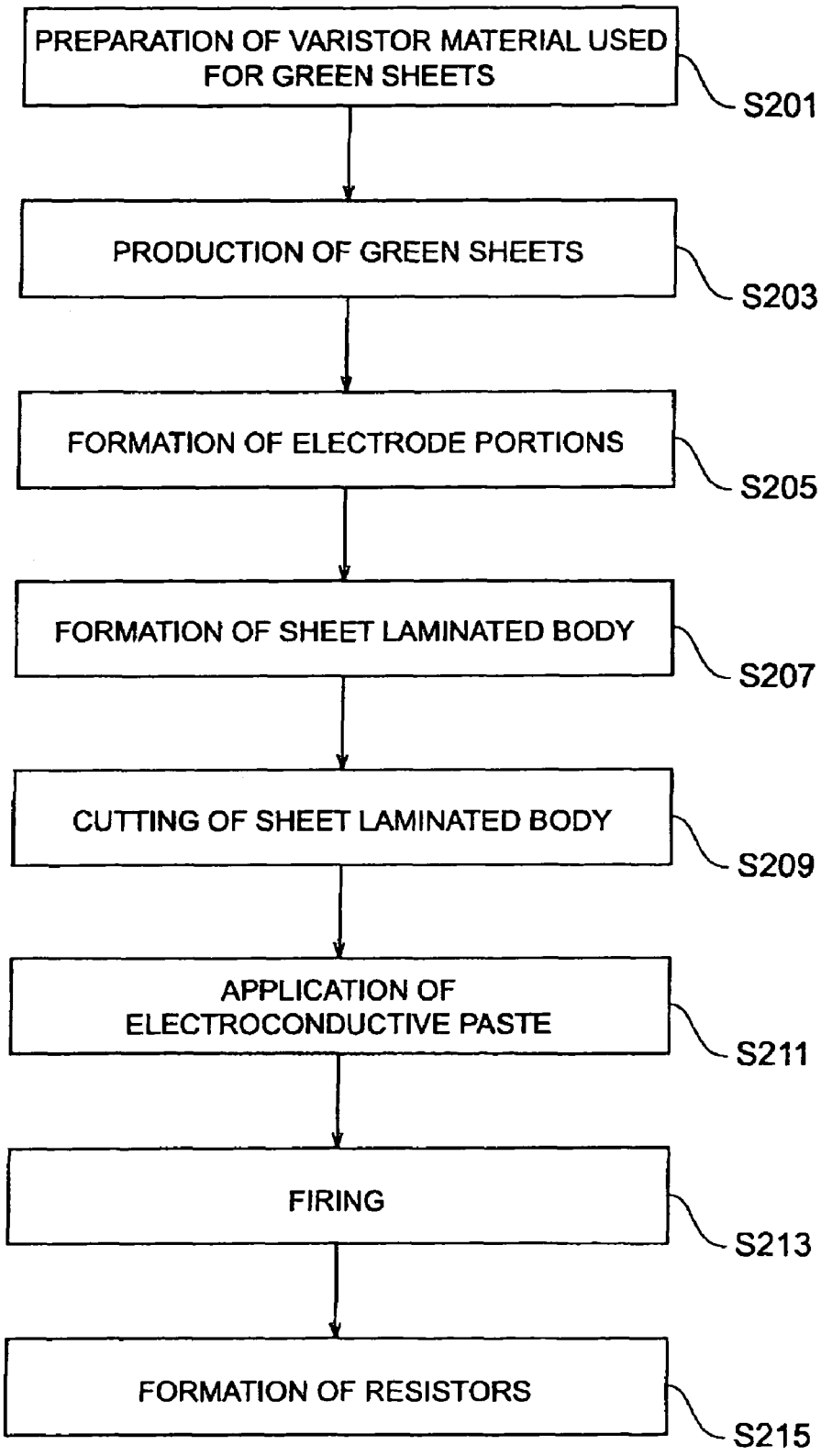
FIG. 10 is a flowchart for explaining a production process of the multilayer chip varistor according to the second embodiment.
Figure 11:
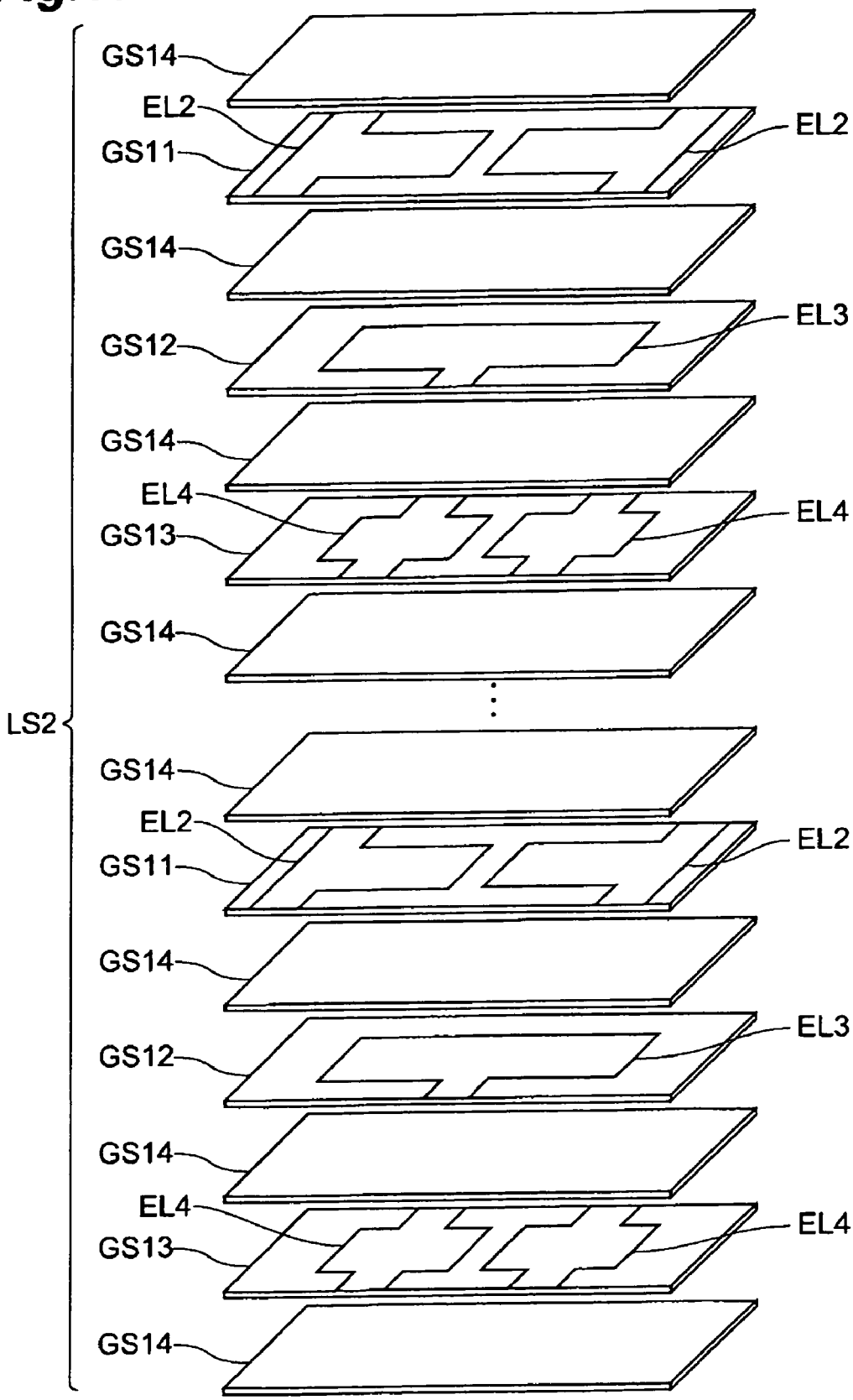
FIG. 11 is an illustration for explaining the production process of the multilayer chip varistor according to the second embodiment.

Subsequently, a production process of the multilayer chip varistor 21 having the above-described configuration will be described with reference to FIGS. 10 and 11. FIG. 10 is a flowchart for explaining the production process of the multilayer chip varistor according to the second embodiment FIG. 11 is an illustration for explaining the production process of the multilayer chip varistor according to the second embodiment First, ZnO as the principal component to form the varistor layer, and the additives of small amount, such as the metals or oxides of Pr, Co, Cr, Ca, Si, K, and Al are weighed at a predetermined ratio, and the components are mixed to prepare a varistor material (step S201). Thereafter, an organic binder, an organic solvent, an organic plasticizer, etc. are added into this varistor material, and they are mixed and pulverized for about 20 hours by a ball mill or the like to obtain a slurry.

The above slurry is applied onto film, for example, of polyethylene terephthalate by a known method such as the doctor blade method, and thereafter dried to form membranes in the thickness of about 30 μm. The membranes obtained in this manner are peeled off from the polyethylene terephthalate film to obtain green sheets (step S203).

Next, a plurality of electrode portions corresponding to the first and second internal electrodes 33, 35 are formed (in a number corresponding to the number of divided chips described later) on green sheets (step S205). Similarly, a plurality of electrode portions corresponding to the third internal electrodes 43 are formed (in the number corresponding to the number of divided chips described later) on other green sheets (step S205). Furthermore, a plurality of electrode portions corresponding to the fourth and fifth internal electrodes 53, 55 are formed (in the number corresponding to the number of divided chips described later) on still other green sheets (step S205). The electrode portions corresponding to the first to fifth internal electrodes 33, 35, 43, 53, 55 are formed by printing an electroconductive paste by a printing method, such as screen printing, and drying it. The electroconductive paste is a paste in which an organic binder and an organic solvent are mixed in metal powder consisting primarily of Pd particles.

Next, green sheets with electrode portions, and green sheets without electrode portions are laminated in a predetermined order to form a sheet laminated body (step S207). The sheet laminated body obtained in this manner is cut in chip units, to obtain a plurality of divided green bodies LS2 (cf. FIG. 11) (step S209). Each resultant green body LS2 consists of a successive laminate of green sheets GS11 with electrode portions EL2 corresponding to the first and second internal electrodes 33, 35 and lead conductors 37*a*, 37*b*, 39*a*, 39*b*, green sheets GS12 with electrode portion EL3 corresponding to the third internal electrode 43 and lead conductor 47, green sheets GS13 with electrode portions EL4 corresponding to the fourth and fifth internal electrodes 53, 55 and lead conductors 57*a*, 57*b*, 59*a*, 59*b*, and green sheets GS14 without electrode portions EL2-EL4. The green sheets GS14 without electrode portions EL2-EL4 may be arranged so that a plurality of green sheets GS14 are laminated at each location as occasion may demand.

Next, the electroconductive paste for the first electrode layers 25*a*-29*a* of the external electrodes 25-29 and for the external electrodes 30*a*-30*d* and the electroconductive paste for the second electrode layers 25*b*-29*b* of the external electrodes 25-29 are applied onto the outer surface of the green body LS2 (step S211). In this step, the electroconductive paste is printed by screen printing so as to contact the corresponding electrode portions EL2-EL4, on the first principal surface of the green body LS2, and the paste is dried to form electrode portions corresponding to the first electrode layers 25*a*-29*a*. Then the electroconductive paste is printed by screen printing on the electrode portions corresponding to the first electrode layers 25*a*-29*a*, and thereafter dried to form electrode portions corresponding to the second electrode layers 25*b*-29*b*. The electroconductive paste is also printed by screen printing so as to contact the corresponding electrode portions EL2, EL4, on the second principal surface of the green body LS2, and is then dried to form electrode portions corresponding to the external electrodes 30*a*-30*d*. The electroconductive paste for the first electrode layers 25*a*-29*a* and for the external electrodes 30*a*-30*d* can be a paste in which an organic binder and an organic solvent are mixed in metal powder consisting primarily of Ag—Pd alloy particles or Pd particles, as described above. The electroconductive paste for the second electrode layers 25*b*-29*b* can be a paste in which an organic binder and an organic solvent are mixed in metal powder consisting primarily of Pt particles, as described above. These electroconductive pastes contain no glass frit.

Next, the green body LS2 with the conductive is subjected to a heat treatment at 180-400° C. and for about 0.5-24 hours to effect debinder, and thereafter it is further fired at 1000-1400° C. for about 0.5-8 hours (step S213) to obtain the varistor element body 23, first electrode layers 25*a*-29*a*, second electrode layers 25*b*-29*b*, and external electrodes 30*a*-30*d*. This firing turns the green sheets GS11-GS14 in the green body LS2 into varistor layers. The electrode portions EL2 become the first and second internal electrodes 33, 35 and lead conductors 37*a*, 37*b*, 39*a*, 39*b*. The electrode portions EL3 become the third internal electrodes 43 and lead conductors 47. The electrode portions ELA become the fourth and fifth internal electrodes 53, 55 and lead conductors 57*a*, 57*b*, 59*a*, 59*b*.

Next, resistors 61, 63 are formed (step S215). This completes the multilayer chip varistor 21. The resistors 61, 63 are formed as follows. First, resistive regions corresponding to the resistors 61, 63 are formed so as to lie between each pair of external electrode 30*a* and external electrode 30*b* and between each pair of external electrode 30*c* and external electrode 30*d*, on the second principal surface 23*b* of the varistor element body 23. The resistive regions corresponding to the resistors 61, 63 are formed by printing the aforementioned resistive paste by screen printing and drying it. Then the resistive paste is baked at a predetermined temperature to obtain the resistors 61, 63.

After the firing, an alkali metal (e.g., Li, Na, or the like) may be diffused from the surface of the varistor element body 23. In addition, an insulating layer (protecting layer) may also be formed except for the regions where the external electrodes 25-29 are formed, on the outer surface of the multilayer chip varistor 21. The insulating layer can be formed by printing glaze glass (e.g., glass made of $SiO_2$, ZnO, B, $Al_2O_3$, etc.) and baking it at a predetermined temperature.

In the present second embodiment, as described above, the green body LS2 contains Pr, the electroconductive paste for the first electrode layers 25*a*-29*a* of the external electrodes 25-29 and for the external electrodes 30*a*-30*d* contains Pd, and the green body LS2 with the electroconductive paste is fired to obtain the varistor element body 23, the first electrode layers 25*a*-29*a*, and the external electrodes 30*a*-30*d*; therefore, the varistor element body 23, first electrode layers 25*a*-29*a*, and external electrodes 30*a*-30*d* are simultaneously fired. This can achieve an improvement in the bonding strength of the varistor element body 23 to the external electrodes 25-29 (first electrode layers 25*a*-29*a*) and to the external electrodes 30*a*-30*d*.

The effect of the improvement in the bonding strength between the varistor element body 23 and the external electrodes 25-29, 30*a*-30*d* is considered to arise from the following phenomenon during the firing. During the firing of the green body LS2 and electroconductive paste, Pr in the green body LS2 migrates to near the surface of the green body LS2, i.e., to near the interface between the green body LS2 and the electroconductive paste. Pr coming to near the interface between the green body LS2 and the electroconductive paste and Pd in the electroconductive paste counter diffuse. The counter diffusion of Pr and Pd can form an oxide of Pr and Pd (e.g., $Pr_2Pd_2O_5$ or $Pr_4PdO_7$ or the like) in the neighborhood of interfaces (including the interfaces) between the varistor element body 23 and the external electrodes 25-29, 30*a*-30*d*. The oxide of Pr and Pd offers the anchor effect to improve the bonding strength between the varistor element body 23 and the external electrodes 25-29, 30*a*-30*d* obtained by the firing.

Incidentally, if the electroconductive paste for formation of the first electrode layers 25*a*-29*a* should contain glass frit, the glass component could separate out to the surfaces of the first electrode layers 25*a*-29*a* during the firing, so as to degrade the plateability and solder wettability. However, since in the present second embodiment the electroconductive paste for formation of the first electrode layers 25*a*-29*a* contains no glass frit, there occurs no degradation of plateability and solder wettability.

In the multilayer chip varistor 21 of the second embodiment, the external electrodes 25, 26, 28, 29 functioning as the input/output terminal electrodes and the external electrodes 27 functioning as the ground terminal electrodes are arranged together on the first principal surface 23*a* of the varistor element body 23. Namely, the multilayer chip varistor 21 is a multilayer chip varistor arranged as a BGA (Ball Grid Array) package. The multilayer chip varistor 21 is mounted on an external substrate by electrically and mechanically (physically) connecting the external electrodes 25-29 to respective lands of the external substrate corresponding to the external electrodes 25-29 by means of solder balls. In a state in which the multilayer chip varistor 21 is mounted on the external substrate, each internal electrode 33, 35, 43, 53, 55 extends in the direction perpendicular to the external substrate.

In the multilayer chip varistor in the form of the BGA package, the area of the external electrodes functioning as the input/output terminal electrodes or ground terminal electrodes is particularly small. For this reason, the bonding strength is so low between the varistor element body and the external electrodes that the external electrodes can be peeled off from the varistor element body. In the multilayer chip varistor 21 of the second embodiment, however, the bonding strength is improved between the varistor element body 23 and the external electrodes 25-29 (first electrode layers 25*a*-29*a*) as described above, and thus the external electrodes 25-29 are prevented from being peeled off from the varistor element body 23.

In the multilayer chip varistors 1, 21 of the first and second embodiments, the varistor element body 3, 23 does not contain Bi. The reason why the varistor element body 3, 23 does not contain Bi is as follows. If the varistor element body contains ZnO as a principal component and also contains Bi and if the external electrodes have the electrode layer formed on the outer surface of the varistor element body by simultaneous firing with the varistor element body, and containing Pd, Bi will react with Pd during the simultaneous firing of the electrode layer with the varistor element body to form a compound of Bi and Pd at the interface between the varistor element body and the electrode layer. The compound of Bi and Pd has poor wettability, particularly, with the varistor element body and acts to degrade the bonding strength between the varistor element body and the electrode layer. For this reason, it becomes difficult to secure the bonding strength between the varistor element body and the electrode layer in a desired state.

The preferred embodiments of the present invention were described above, but it is noted that the present invention is by no means limited to these embodiments. For example, the multilayer chip varistor 1 described above had the structure in which the varistor layer was interposed between a pair of internal electrodes, but a varistor according to the present invention may be a multilayer chip varistor in which a plurality of such structures are stacked From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A varistor comprising a varistor element body in which a plurality of varistor layers are laminated, and an external electrode disposed on the varistor element body, wherein the plurality of varistor layers comprises ZnO as a principal component, and a rare-earth metal, and does not comprise Bi, wherein the external electrode comprises an electrode layer disposed on an external surface of the varistor element body so that the external electrode and the plurality of varistor layers are in contact with each other, and comprising Pd, and wherein a compound of the rare-earth metal in the plurality of varistor layers and Pd in the electrode layer exists directly at an interface between the plurality of varistor layers and the external electrode.

2. The varistor according to claim 1, wherein the electrode layer is formed on the external surface of the varistor element body by simultaneous firing with the varistor element body.

3. The varistor according to claim 1, wherein the rare-earth metal in the varistor element body is Pr.

4. The varistor according to claim 1, wherein the external electrode further comprises another electrode layer disposed on said electrode layer.

* * * * *